US009671185B2

(12) United States Patent
Rowe et al.

(10) Patent No.: US 9,671,185 B2
(45) Date of Patent: Jun. 6, 2017

(54) MINIGUN WITH IMPROVED ACCESS DOOR

(71) Applicant: PROFENSE, LLC, Phoenix, AZ (US)

(72) Inventors: Thomas Rowe, Phoenix, AZ (US); Arthur O'Donnell, Gilbert, AZ (US)

(73) Assignee: Profense, LLC, Phoenix, AZ (US)

( * ) Notice: Subject to any disclaimer, the term of this patent is extended or adjusted under 35 U.S.C. 154(b) by 0 days.

(21) Appl. No.: 14/893,162

(22) PCT Filed: Jun. 3, 2014

(86) PCT No.: PCT/US2014/040767
§ 371 (c)(1),
(2) Date: Nov. 23, 2015

(87) PCT Pub. No.: WO2015/030892
PCT Pub. Date: Mar. 5, 2015

(65) Prior Publication Data

US 2016/0195349 A1 Jul. 7, 2016

Related U.S. Application Data

(60) Provisional application No. 61/830,547, filed on Jun. 3, 2013.

(51) Int. Cl.

| | |
|---|---|
| ***F41F 1/00*** | (2006.01) |
| ***F41A 9/36*** | (2006.01) |
| ***F41A 9/58*** | (2006.01) |
| ***F41A 17/36*** | (2006.01) |
| ***F41A 35/02*** | (2006.01) |
| ***F41F 1/10*** | (2006.01) |

(52) U.S. Cl.
CPC *F41A 9/36* (2013.01); *F41A 9/58* (2013.01); *F41A 17/36* (2013.01); *F41A 35/02* (2013.01); *F41F 1/10* (2013.01)

(58) Field of Classification Search
CPC ..... F41A 9/36; F41F 1/10
USPC ..... 89/12
See application file for complete search history.

(56) References Cited

U.S. PATENT DOCUMENTS

| | | | | | |
|---|---|---|---|---|---|
| 2,706,356 | A * | 4/1955 | De Vita | F41F 1/08 | 102/703 |
| 3,380,343 | A * | 4/1968 | Chiabrandy | F41F 1/10 | 89/12 |
| 3,434,380 | A * | 3/1969 | Dardick | F41A 9/27 | 42/39.5 |
| 3,437,039 | A * | 4/1969 | Hawthorne | F42B 5/03 | 102/436 |

(Continued)

*Primary Examiner* — Samir Abdosh
(74) *Attorney, Agent, or Firm* — Richard E. Oney; Tiffany & Bosco

(57) ABSTRACT

An improved door assembly for a delinking feeder of a minigun includes an access door mounted to a delinking feeder housing and movable between a closed position and an open position. The access door has an enclosed recess for receiving a tongue that is rotationally coupled to the access door and is movable between a retracted position and a deployed position. When the access door is in the open position, the tongue is in the deployed position and a tongue first contact surface can contact and secure a linked cartridge positioned in the delinking feeder. When the access door is in the closed position, the tongue is in the retracted position and a tongue second contact surface can contact and guide a cartridge positioned in the delinking feeder.

6 Claims, 20 Drawing Sheets

(56) References Cited

U.S. PATENT DOCUMENTS

| | | | | |
|---|---|---|---|---|
| 6,443,044 | B1 * | 9/2002 | Dillon | F41A 9/36<br>89/12 |
| 7,971,515 | B2 * | 7/2011 | Garwood | F41A 9/31<br>89/12 |

* cited by examiner

MINIGUN WITH IMPROVED ACCESS DOOR

RELATED APPLICATION AND PRIORITY CLAIM

This application claims the benefit of U.S. Provisional Application No. 61/830,547, filed Jun. 3, 2013, entitled "Mini-Gun with Improved Access Door" which is incorporated herein by reference.

BACKGROUND

This invention relates generally to Gatling-type miniguns. More specifically, it relates to an improved access door assembly for the feeder of a Gatling-type minigun.

Gatling-type miniguns have been known for many years. The Gatling-type minigun is a multi-barreled machine gun with a high rate of fire (2,000 to 6,000 rounds per minute). It features Gatling-style rotating barrels with an external power source, such as an electric motor. One previous example of such a gun is described in U.S. Pat. No. 7,971,515 B2, entitled "Access Door for Feeder and Delinker of a Gatling Gun," which is incorporated herein by this reference. Long existing motivations in the design of Gatling-type miniguns have been to minimize jams, extend the operational life and improve ease of use of such guns.

Gatling-type miniguns include a delinking feeder assembly, which is an ammunition feed device that receives an ammunition belt of linked cartridges, sequentially separates or "delinks" the cartridges from the ammunition belt, and feeds the cartridges to the minigun for firing. An access door assembly is mounted on the delinking feeder assembly for providing access to the interior of the delinking feeder. It is a principal object of the present invention to provide an improved access door assembly for a delinking feeder of such a minigun.

Additional objects and advantages of the invention will be set forth in the description that follows, and in part will be apparent from the description, or may be learned by practice of the invention. The objects and advantages of the invention may be realized and obtained by means of the instrumentalities and combinations pointed out in the appended claims.

SUMMARY

To achieve the foregoing objects, and in accordance with the purposes of the invention as embodied and broadly described in this document, there is provided an improved door assembly for a delinking feeder of a minigun. The door assembly includes an access door mounted to a delinking feeder housing and movable between a closed position and an open position. The access door has an enclosed recess for receiving a tongue having a first contact surface for contacting and securing a linked cartridge positioned in the delinking feeder when the access door is in the open position. The tongue is rotationally coupled to the access door and is movable between a retracted position, wherein a portion of the tongue is disposed in the enclosed recess, and a deployed position, wherein the portion of the tongue is deployed from the access door. When the access door is in the open position, the tongue is in the deployed position and the tongue first contact surface can contact and secure a linked cartridge positioned in the delinking feeder.

According to another aspect of the invention, the tongue includes a second contact surface for contacting and guiding a cartridge positioned in the delinking feeder when the access door is in the closed position. When the access door is in the closed position, the tongue is in the retracted position and the tongue second contact surface can contact and guide a cartridge positioned in the delinking feeder.

BRIEF DESCRIPTION OF THE DRAWINGS

The accompanying drawings and appendices, which are incorporated in and constitute a part of the specification, illustrate the presently preferred embodiments of the invention and, together with the general description given above and the detailed description of the preferred methods and embodiments given below, serve to explain the principles of the invention.

DESCRIPTION

Figure 1A:
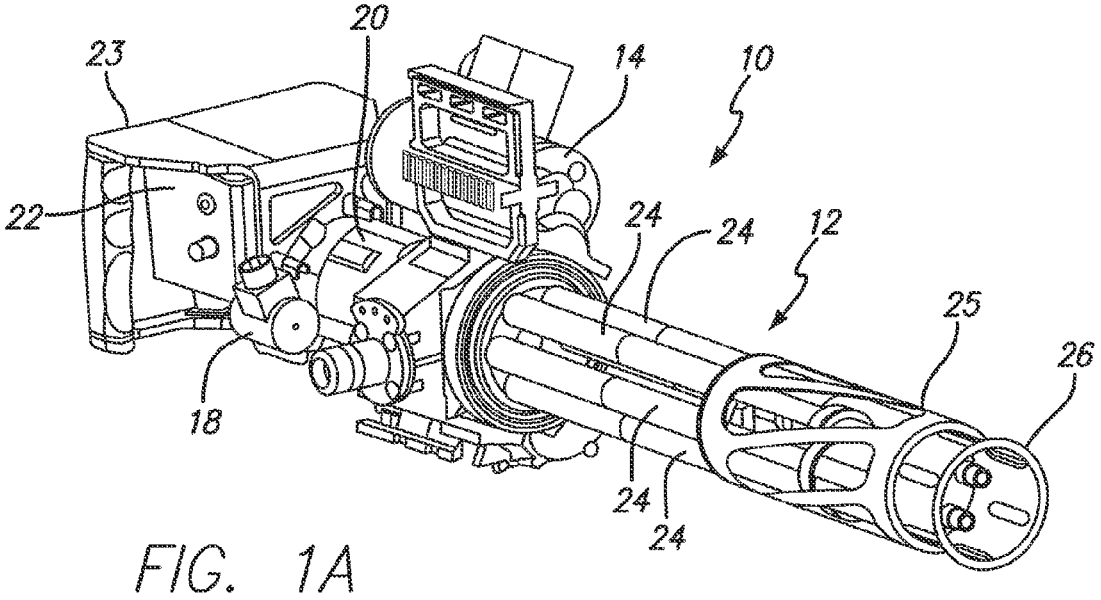
FIG. 1A is a top perspective view showing a side of an embodiment of an electrically-powered minigun that includes one embodiment of an improved feeder door assembly according to the present invention.

A preferred embodiment of a feeder door assembly according to the present invention is shown and generally designated by the reference numeral 30.

Figure 1B:
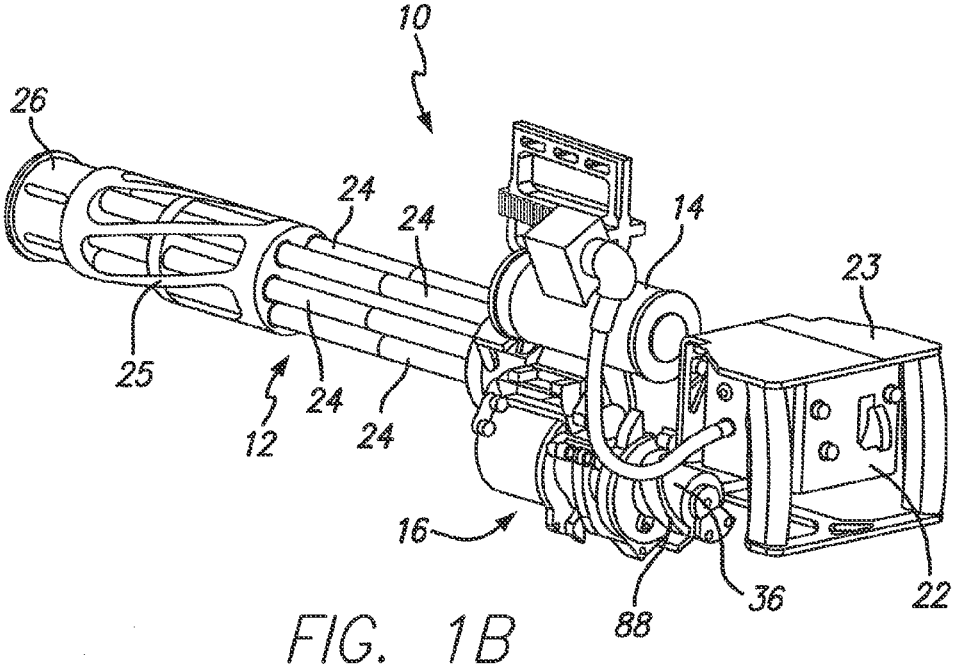
FIG. 1B is a top perspective view showing the other side of the minigun of FIG. 1A.

FIGS. 1A and 1B illustrate a 7.62×51 mm minigun 10 suitable for use with the present invention. The minigun 110 includes a barrel assembly 12, an electric drive motor 14 to rotate the barrel assembly 12, a delinking feeder 16, a clutch assembly 18, a gun housing assembly 20, a gun control unit 22, and a spade grip 23. The barrel assembly 12 includes a barrel clamp assembly 25, a plurality of barrels 24 circumferentially mounted to the barrel clamp assembly 25, and a flash suppressor 26. Ammunition is fired sequentially through the barrels 24 in a known fashion, i.e., first one barrel is used, then the next, then the next, etc. An electric cable 28 supplies power from the gun control unit 22 to the drive motor 14. The delinking feeder 16, which is an ammunition feed device, is engaged and disengaged via the electric cable 28. To provide access to the interior of the delinking feeder 16, a feeder door assembly 30 is mounted on the delinking feeder 16. The feeder door assembly 30 includes an access door 32 that is movable between a first closed operative position and a second open position to facilitate the loading of an ammunition belt 101 of linked cartridges 80. A portion of such an ammunition belt is depicted in FIG. 2.

As is well known to those of skill in the art, in the operation of the minigun 10, the drive motor 14 causes the barrel assembly 12 to rotate, and each barrel 24 fires sequentially in rapid succession. During such operation, the delinking feeder 16 receives the ammunition belt 101 of linked cartridges 80 (see FIG. 2), sequentially separates or "delinks" the cartridges 80 from the ammunition belt 101 and feeds the cartridges 80 to the minigun firing mechanism (not shown).

Still referring to FIGS. 1A and 1B, when an arming switch on the gun control unit 22 is activated, and one or both firing buttons are then depressed, the gun will fire. When the firing buttons are released, the delinking feeder 16 is disengaged so the ammunition supply is discontinued. The electric drive motor 14 continues to rotate for about 200 to 400 milliseconds so that the weapon is cleared of remaining ammunition before stopping. A booster motor override control button on the gun control unit 22, when depressed, activates an ammunition booster motor on the ammunition magazine (not shown) to facilitate the loading of the weapon. The booster motor pushes the ammunition belt 101 from the ammunition magazine, through the feed chute, and to the weapon where it is inserted in the delinking feeder 16, readying the weapon for firing.

Figure 2:
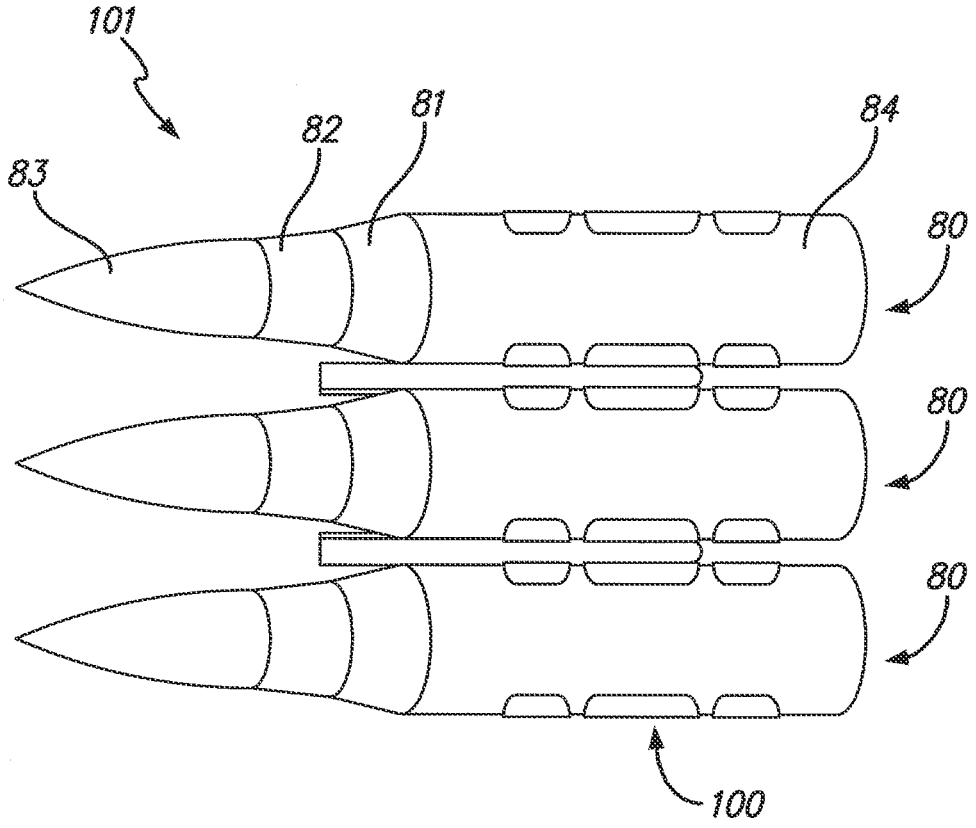
FIG. 2 PRIOR ART
FIG. 2 is a perspective view showing an ammunition belt of the prior art.

Referring to FIG. 2, each of the cartridges 80 in the ammunition belt 101 includes a cylindrical hollow casing 84 comprising the rear portion of cartridge 80. A primary conical tapered shoulder 81 extends from casing 84 to a conical tapered neck 82. Neck 82 extends from the shoulder 81 to a projectile or bullet 83.

Figure 3:
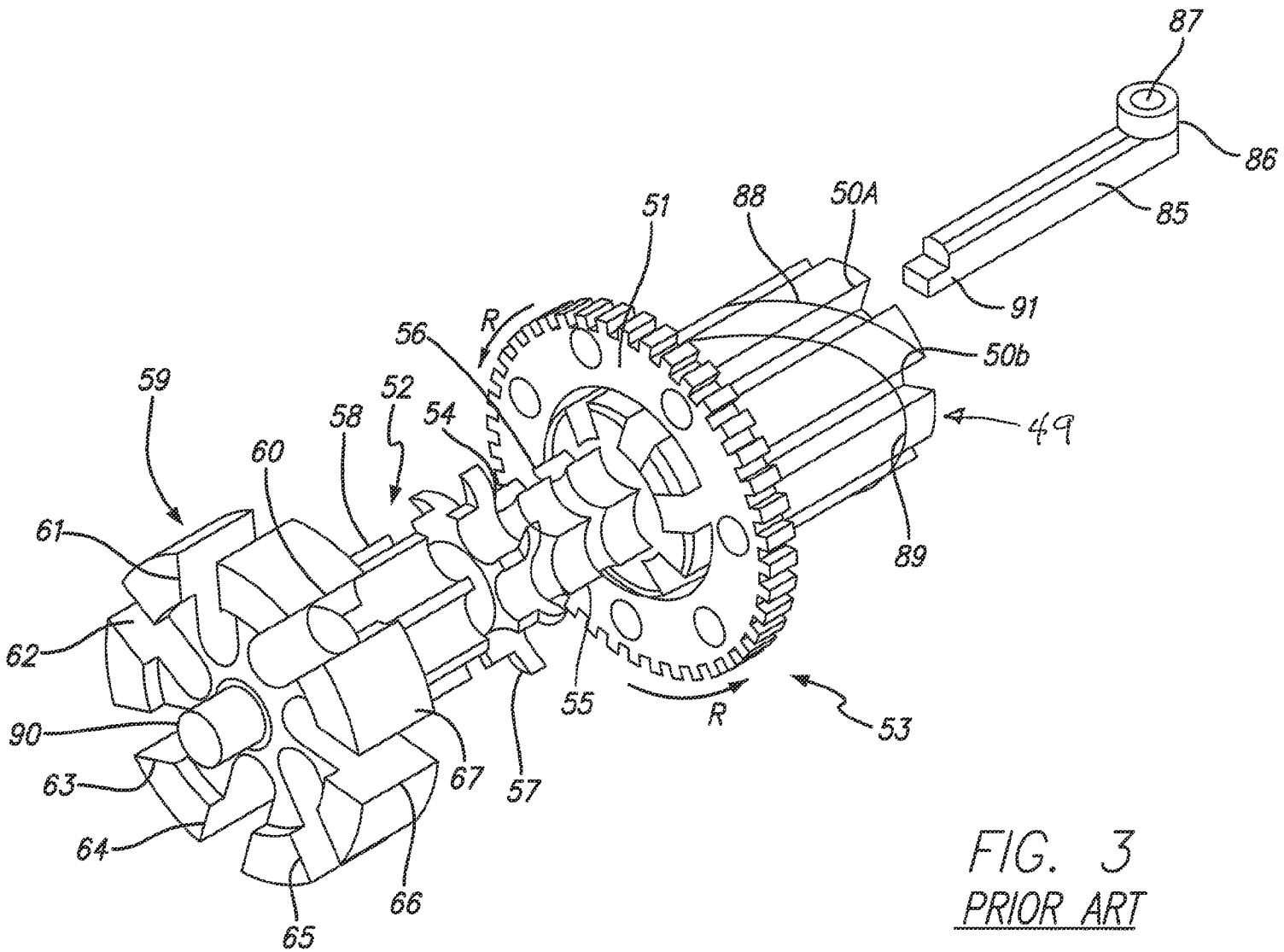
FIG. 3 PRIOR ART
FIG. 3 is a perspective view showing the interior of a prior art delinking feeder.

FIG. 3 illustrates internal components of a prior art delinking feeder 16. As shown in FIG. 3, a guide assembly 53 includes feeder shaft 90 that rotates (in a direction indicated by arrows R) on an axis that is parallel to the axis about which the barrel assembly 12 rotates. During operation, the guide assembly 53 continuously rotates to receive the ammunition belt 101, to remove cartridges 80 from the belt, and to feed the cartridges 80 for firing. Securely mounted to the feeder shaft 90 is a series of components, including a push rod guide 49, a toothed drive gear 51, sprockets 55, 56, a stripper sleeve 52 (including sprockets 54, 57 and 58), and a feeder sprocket 59. The drive motor 14 is rotationally coupled, via the drive gear 51, to the feeder shaft 90 and the push rod guide 49, sprockets 55, 56, stripper sleeve 52, and feeder sprocket 59. Each of the sprockets 54-58 has seven equally spaced grooves, with each groove having a generally semi-cylindrical shape for receiving a cartridge 80. Sprockets 55 and 56 comprise a cartridge holding construct for holding cartridges 80 that are linked to an ammunition belt 101 that has been inserted into the delinking feeder 16.

Still referring to FIG. 3, the guide assembly 53 includes a plurality of push rods 85, with one push rod 85 corresponding to each barrel 24 of the minigun 10. For example, in a minigun with a barrel assembly having six barrels 24, the guide assembly 53 has six push rods 85. The push rod guide 49 has a generally cylindrical body with longitudinal slots 50A uniformly distributed about its surface. Each of the push rods 85 can move longitudinally inside its associated longitudinal slot 50A. An arcuate outer surface 50B extends between each adjacent pair of slots 50A. Each groove in a sprocket 54 to 59 is aligned with one of the slots 50A. Each slot 50A slidably receives a push rod 85. Each push rod 85 has a wheel 86 rotatably secured to its rearward end by an axle 87 that extends outwardly from the outer face of the push rod 85. Each wheel 86 is confined within a spiral grooved channel, represented in FIG. 3 by the broken lines 88, which is incorporated into a feeder cam housing 36, as shown in FIG. 1B. As the push rod guide 49 is rotated about its axis by means of the drive motor 14, each of the push rods 85 is constrained by its respective drive wheel 86 to follow the path of the spiral channel 88, thereby slidably moving forward and backward in its associated longitudinal slot 50A with each rotation of the push rod guide 49. As a push rod 85 moves forward toward the drive gear 51, the push rod distal end 91 engages the rear of a cartridge 80 and pushes the cartridge 80 forward. As the cartridge 80 is driven forward, it is freed, or delinked, from the link 100 holding it (see FIG. 2) and is pushed toward and into the feeder sprocket 59 to be handed off to the minigun firing mechanism (not shown).

Still referring to FIG. 3, the stripper sleeve 52 (which includes sprockets 54, 57 and 58) is designed to receive and prevent longitudinal movement of a cartridge link 100 in the ammunition belt 101 so that a cartridge 80 can be pushed free of its associated link 100 by one of the push rods 85, i.e., the stripper sleeve 52 "holds" the cartridge link 100 while the cartridge 80 is pushed free by one of the push rods 85. The feeder sprocket 59 receives each cartridge 80 that is separated from the ammunition belt 101, and then hands off the cartridge 80 for firing.

Figure 4:
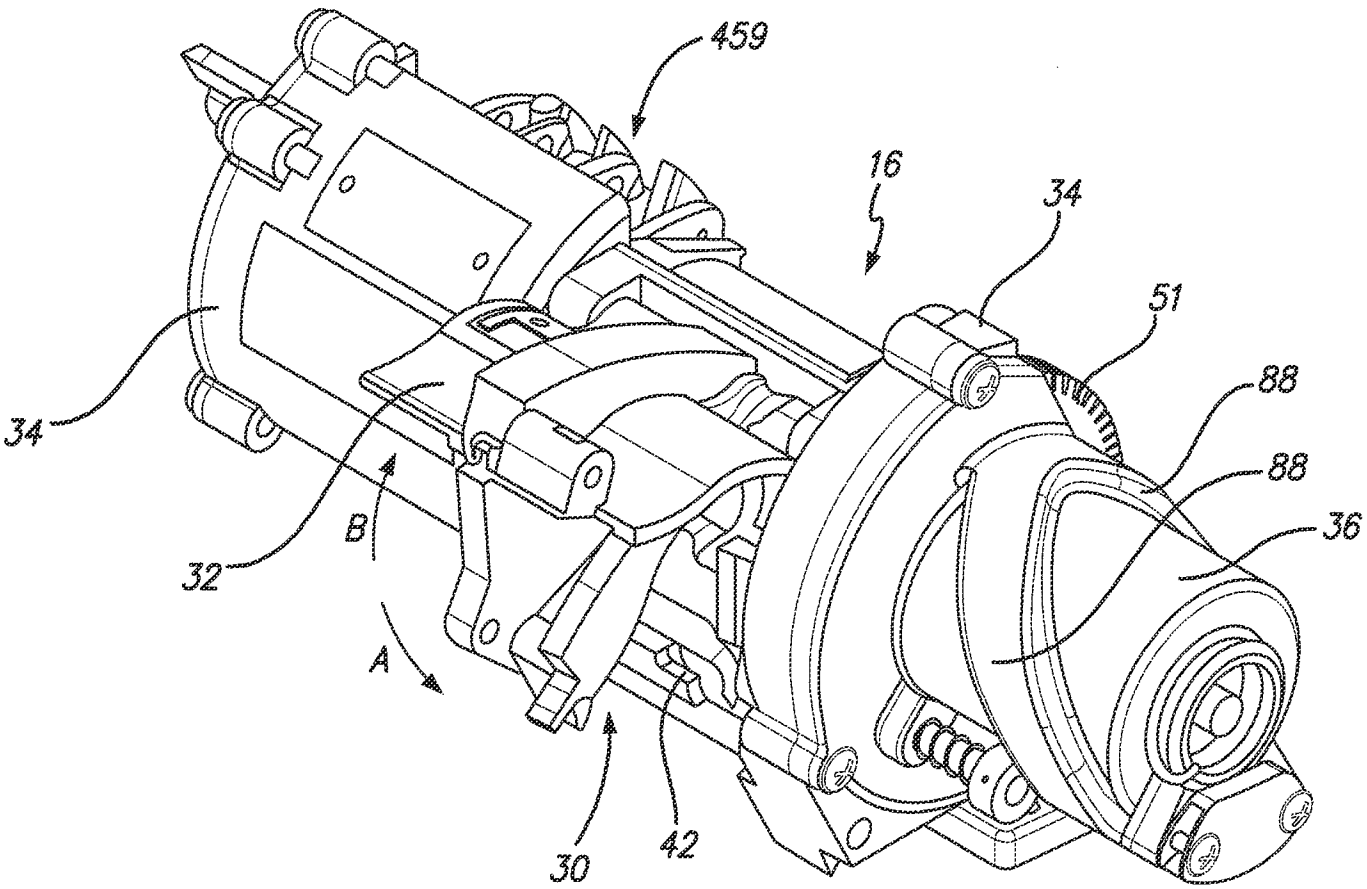
FIG. 4 is a top perspective view of the delinking feeder of the minigun of FIGS. 1A and 1B, showing one embodiment of a feeder door assembly according to the present invention with the access door in a fully open position.
Figure 5:
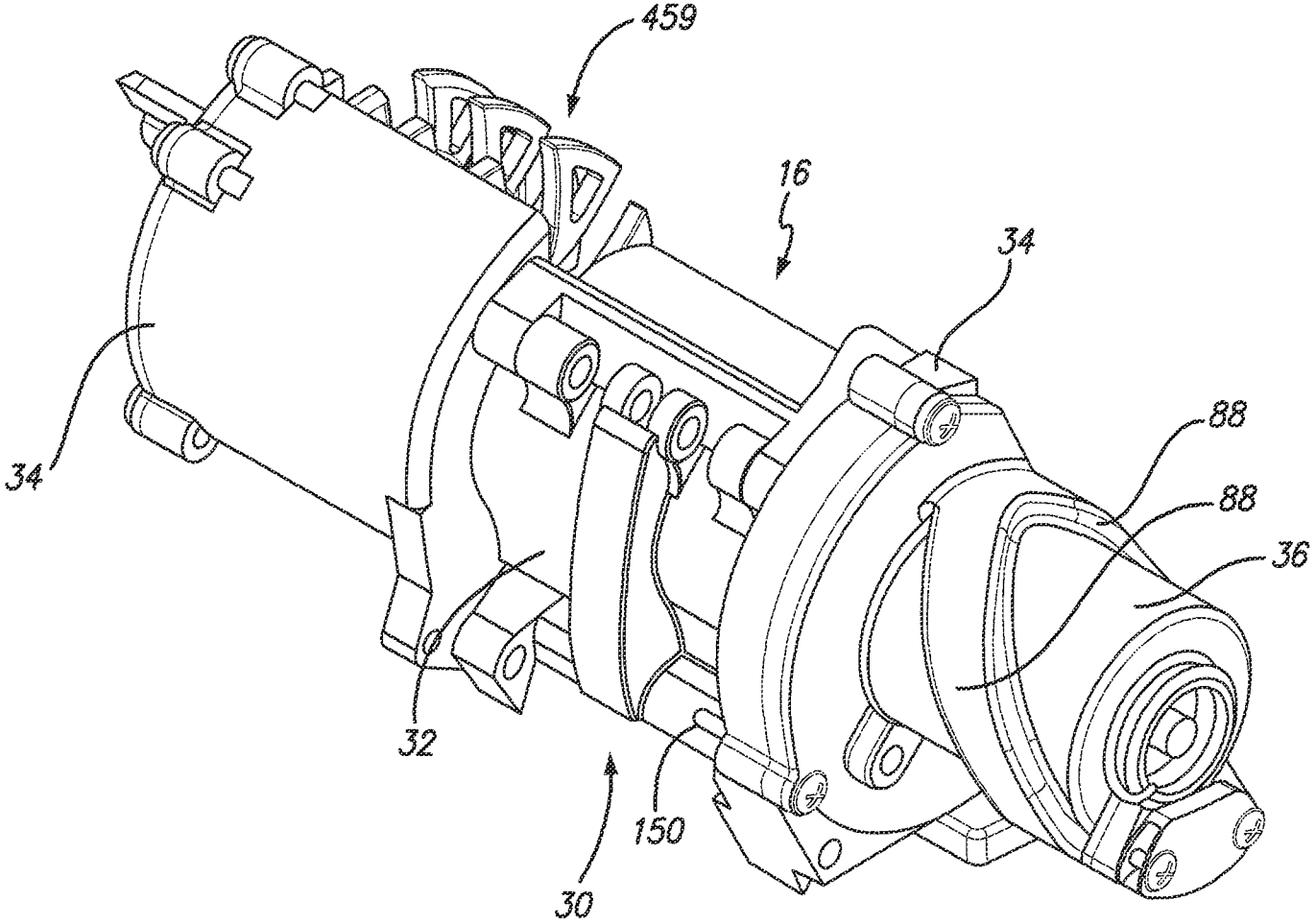
FIG. 5 is a top perspective view of the delinking feeder of FIG. 4, showing the improved feeder assembly with the access door in a closed position.
Figure 12:
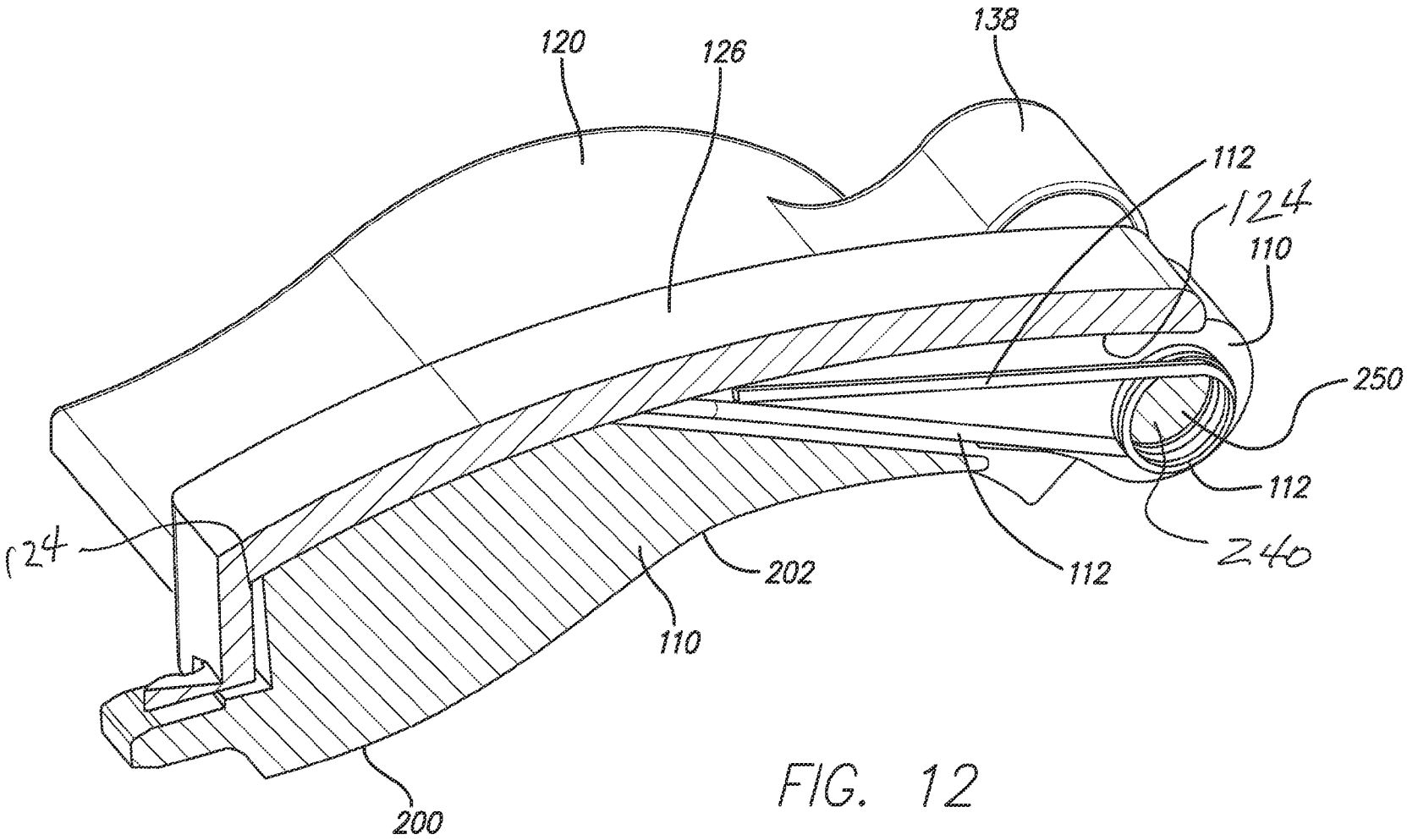
FIG. 12 is a perspective cross-sectional view of a portion of the feeder door assembly of FIG. 6, showing the tongue and the torsion spring under tension with the access door closed.
Figure 13:
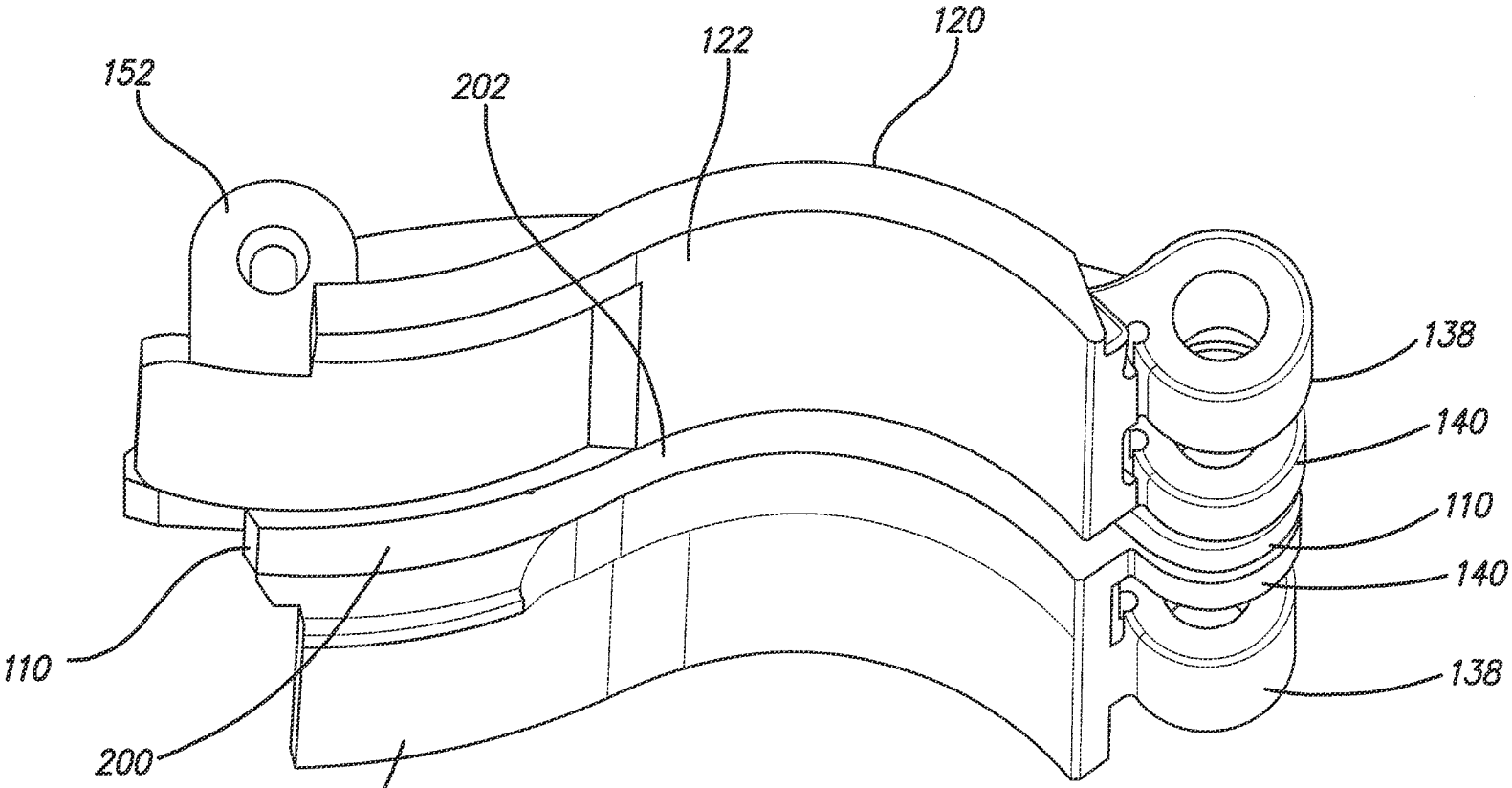
FIG. 13 is a bottom perspective view of the feeder door assembly of FIG. 6 with the access door closed, showing the tongue disposed in the access door recess.

As previously mentioned, the feeder door assembly 30 facilitates the loading of the ammunition belt 101. Referring now to FIGS. 4-15, one embodiment of the improved feeder door assembly 30 includes a single access door 32 having an enclosure 126 defining a recess 124 in an inner surface 122 of the access door 32. The access door 32 includes mounting sleeve portions 138, 140 for pivotally mounting the door 32 on a door hinge pin 240, which in turn is mounted to the feeder housing assembly (see FIG. 15). The access door 32 movable between a closed position, as shown in FIG. 5, and an open position, as shown in FIG. 4. The access door 32 includes a tongue 110 that also is pivotally mounted to the door hinge pin 240 and is configured for contacting and securing a linked cartridge 80 in the delinking feeder sprockets 55, 56 and stripper sleeve 52 when the access door 32 is in the open position (or in a partially open position). The tongue 110 is movable between a retracted position, wherein a portion of the tongue 110 stored in the recess 124 (see FIGS. 12-14) and a deployed position, wherein a portion of the tongue 110 deployed from the access door 32 (see FIG. 4). The tongue 110 includes a spring recess 114 for holding a torsion spring 112. The torsion spring 112 is under tension and causes the tongue 110 to pivot about the pin 240 to the deployed position when the door 32 is in the completely opened or partially opened position, as can be seen in FIG. 4. When the access door 32 is in the closed position, as can be seen in FIG. 12, a portion of the tongue 110 is disposed in the door recess 124.

As can be seen in FIGS. 6 and 9-15, the tongue 110 has a bottom surface including a first contact surface 200 and a second contact surface 202. The first contact surface 200 is provided for bearing against a cartridge 80 when the door 32 is partially open portion. The second contact surface 202 is configured to have a profile that matches the profile of the access door inner surface 122 (see FIGS. 13-14) so that, when the access door 32 is closed, the inner door surface 122 and the second contact surface 202 form a substantially continuous sliding surface for helping to control the cartridge 80 as it is feed into the feeder sprocket 59.

Figure 14:
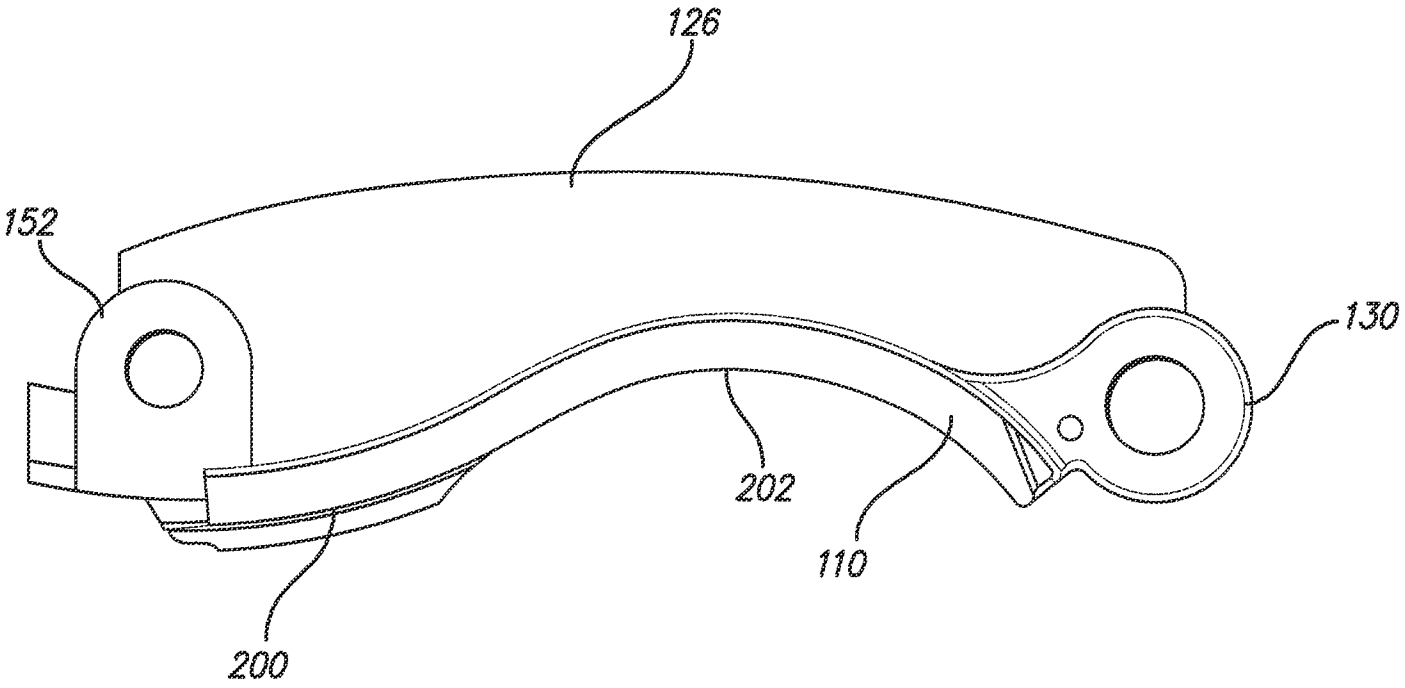
FIG. 14 is a side elevation view of the feeder door assembly of FIG. 6 with the access door closed.
Figure 15:
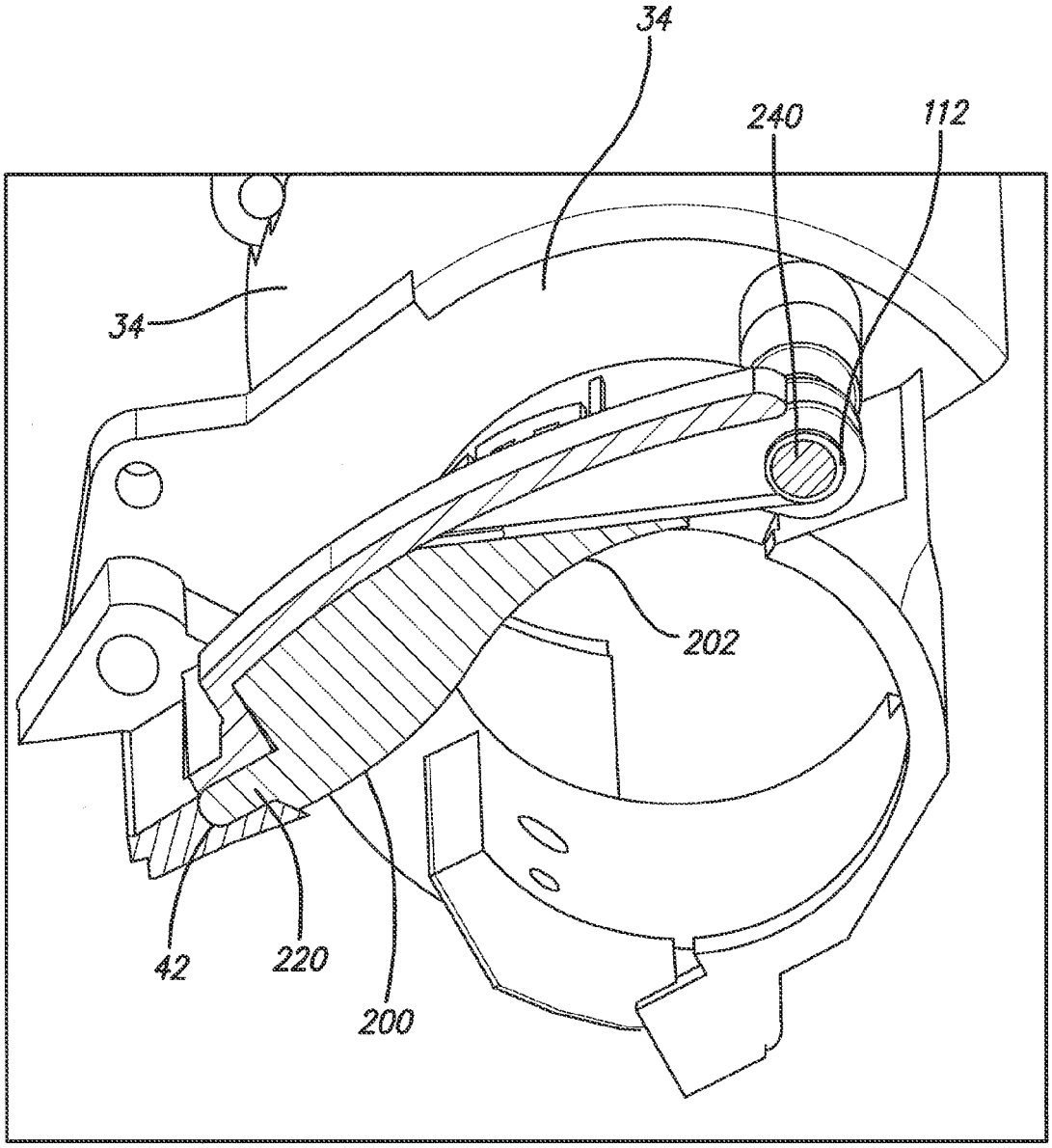
FIG. 15 is a cutaway perspective view of the feeder door assembly of FIG. 6, showing the access door mounted to the feeder housing and in the closed position.
Figure 17:
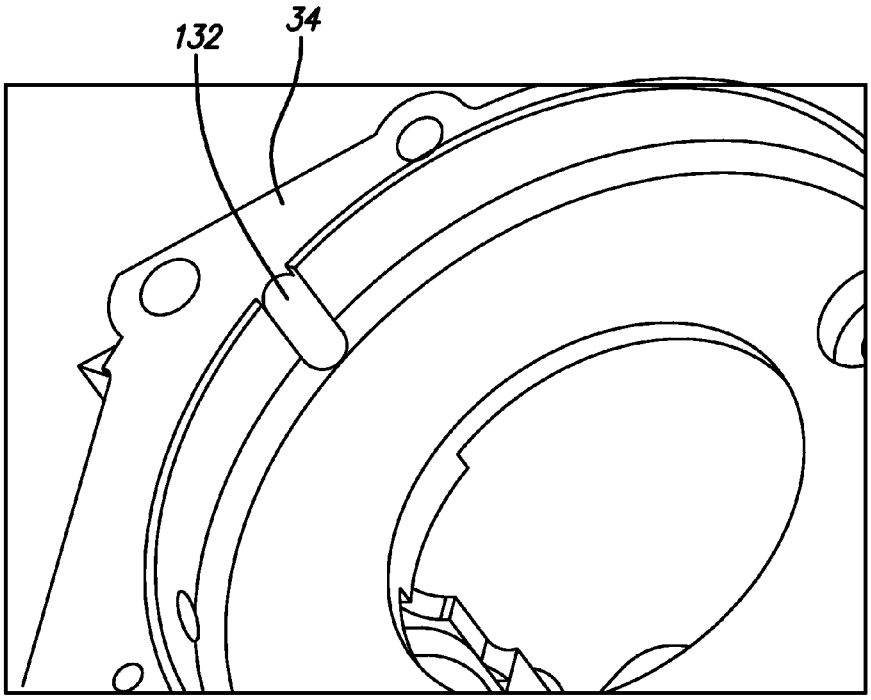
FIG. 17 is a perspective view of a portion of the interior of the feeder housing, showing a housing hinge aperture for receiving the hinge pin of the feeder door assembly.

The tongue 110 includes a stop tab 220 at one end and a hinge pin opening 250 at the other end. As shown in FIG. 15, a door hinge pin 240 extends through the opening 250 to pivotally mount the tongue 110 to the base 120. The door hinge pin 240 extends into hinge apertures 132 in the feeder housing 34 (see FIG. 17) on either side of the feeder door assembly 30. The torsion spring 112 is also mounted to the door hinge pin 240 with its legs extending into the spring recess 121 extending along a length of the tongue 110 (see FIGS. 10-12 and 15). The torsion spring 112 generates a force that causes the tongue 110 to pivot about the hinge pin 240 and that displaces the tongue 110 to a deployed position when the door 32 is in the completely opened position illustrated in FIG. 4 (or when the door 32 is in a partially opened position). When the access door 32 is in a partially opened position, the first contacting portion 200 of tongue 110 contacts the casing 84 of a cartridge 80 positioned in the delinking feeder 16. As a user moves the door 32 in the direction of arrow A from the opened position of FIG. 4 toward the closed position of FIG. 5, the force generated by the torsion spring 112 is overcome as the spring 112 is compressed, and the door recess enclosure 126 is moved downwardly over the tongue 110 to the position illustrated in FIGS. 12-15.

The access door 32 can be opened in the direction of arrow B to a completely opened position, as shown in FIG. 4, to allow greater access to the interior of the delinking feeder 16 so that a user can position a cartridge 80 in the interior of the delinking feeder 16. Referring to the embodiment of the tongue 110 in FIG. 21, the degree to which the torsion spring 112 can displace the tongue 110 outwardly from door recess 124 is controlled by a rotational stop tab 222 disposed near the tongue opening 250. The rotational stop tab 222 has two opposing surfaces 224, 226 that limit the range of rotational travel of the tongue 110 and the access door 32. One surface 224 limits the rotation of the tongue 110 with respect to the access door when it contacts the recess enclosure 126 and thereby limits the degree to which the torsion spring 112 can displace the tongue 110 outwardly from door recess 124. For example, FIG. 4 illustrates the door 32 in an open position in which the tongue 110 is outwardly displaced by the torsion spring 112 from the door recess 124 to the greatest extent possible. The other surface 226 limits the range of rotational travel of the door 32 with respect to the feeder housing 34 to prevent the door 32 from opening too far when it is in the fully open position.

Figure 21:
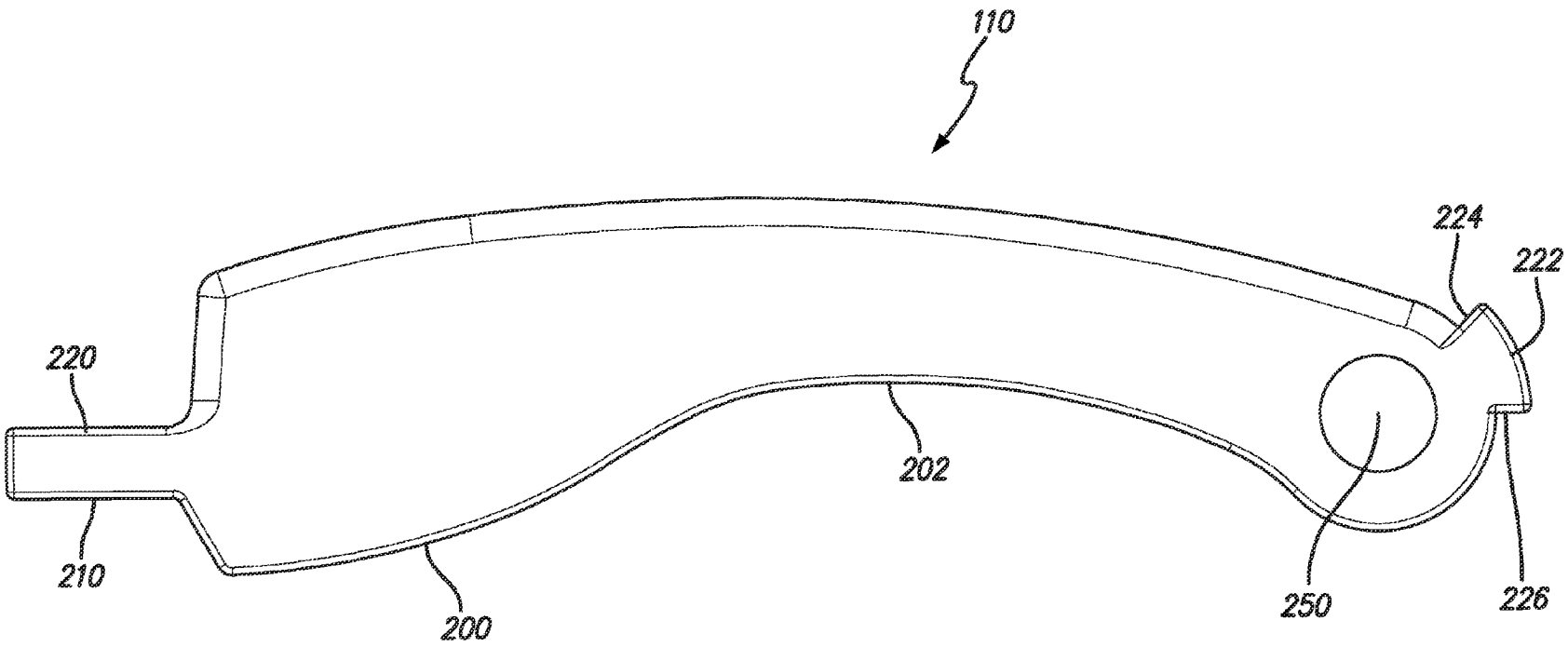
FIG. 21 is a side view of an alternative embodiment of the feeder door tongue of an improved feeder door according to the present invention.

With the tongue embodiment of FIG. 21, when the door 32 is in the completely open position (see FIG. 4), the tongue first contact surface 200 is spaced apart from, above, and not contacting a cartridge 80 in the delinking feeder. When the door 32 is moved from the completely open position in the direction of arrow A in FIG. 4, the tongue 110 moves simultaneously with the door 32 in the same direction of travel as the door 32 until the tongue first contact surface 200 contacts and bears against a cartridge 80 positioned in the delinking feeder 16. Continuing to close the door 32 in the direction of arrow A compresses the torsion spring 112 and forces the recess enclosure 126 downwardly over the tongue 110 so that the tongue 110 is in a retracted position with a portion of the tongue 110 disposed within the door recess 124 (see FIGS. 12-15).

Figure 20:
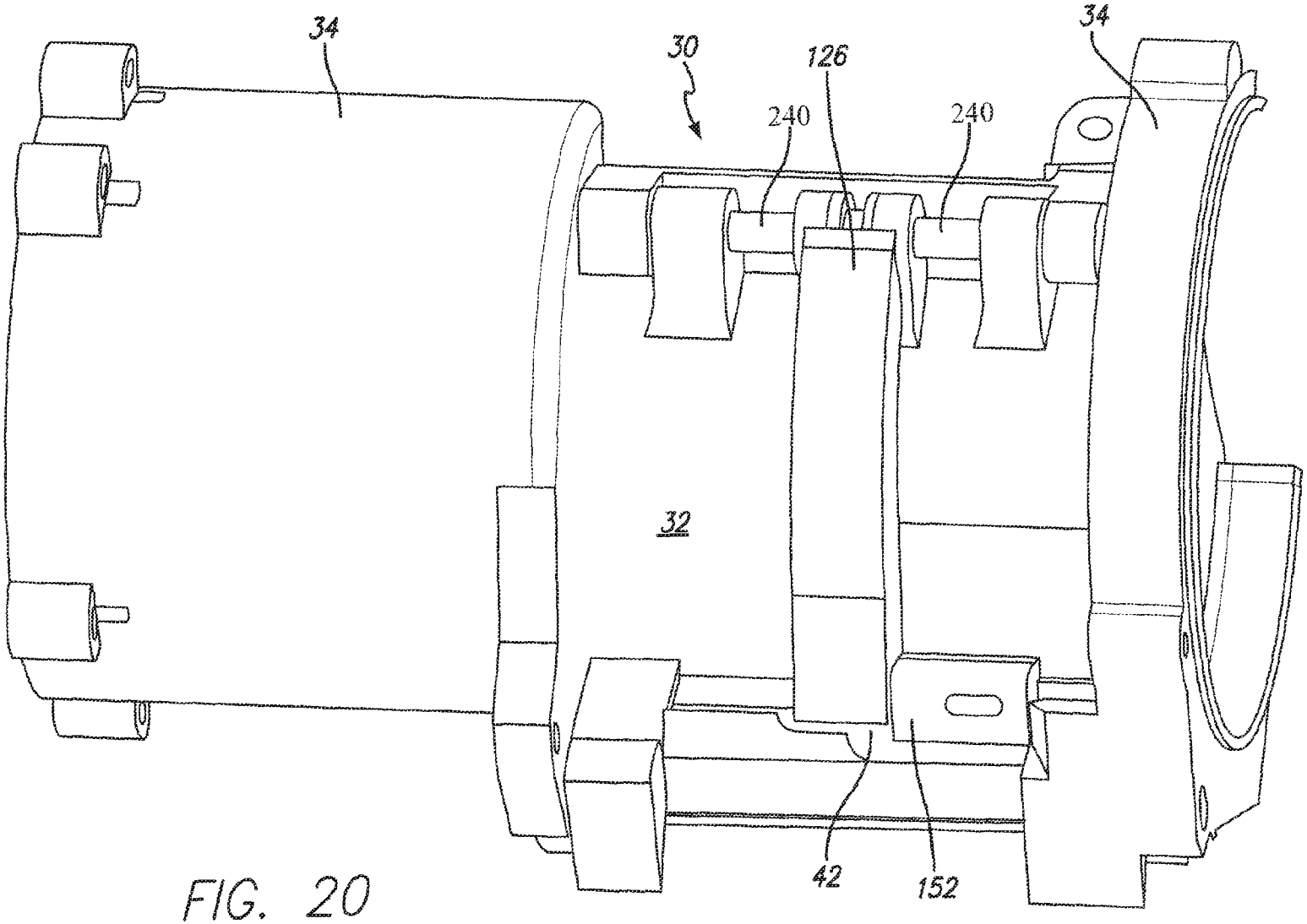
FIG. 20 is an enlarged perspective view of the feeder housing with door assembly closed, illustrating how the housing and assembly provide an enclosed environment for operation of the delinking feeder.

Referring again to FIGS. 4-5 and 20, a shelf 42 is formed in the delinking feeder housing. With the door 32 in the open position of FIG. 4, the deployed tongue 110 is displaced outwardly to the fullest extent possible. As the door 32 is moved downward in the direction of arrow A from the open position of FIG. 4 to the closed position of FIG. 5, the contact surface 200 of the tongue 110 bears against a cartridge 80, which prevents downward movement of tongue 110. As the door 32 is moved to the fully closed position, as shown in FIG. 14, the stop tab 220 comes to rest on the shelf 42 and the tongue retracts into the door recess 124. When the door 32 is subsequently opened, the stop tab 220 is lifted off the shelf 42.

As can be seen in FIG. 14, when the door 32 is closed, the second contact surface 202 of the bottom of tongue 110 is positioned over the cartridges 80 in the delinking feeder. As previously explained, the second contact surface 202 is configured to have a profile that matches the profile of the access door inner surface 122 (see FIGS. 13-14). In this configuration, when the access door 32 is closed, the inner door surface 122 and the second contact surface 202 form a substantially continuous sliding surface for helping to guide the cartridge 80 as it is feed into the feeder sprocket 59 of the delinking feeder 16.

Figure 6:
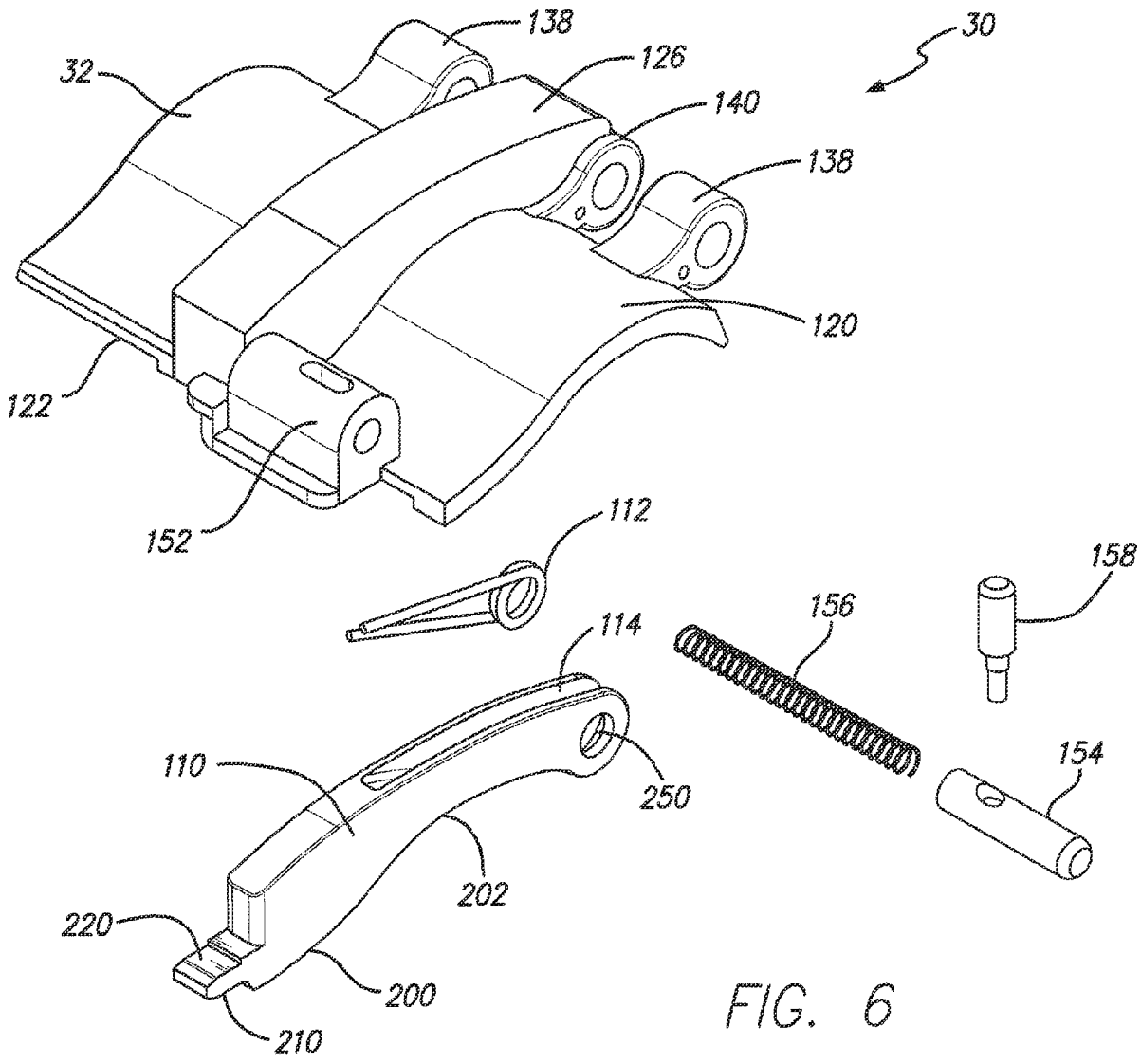
FIG. 6 is an exploded view of one embodiment of an improved feeder door assembly according to the present invention.
Figure 7:
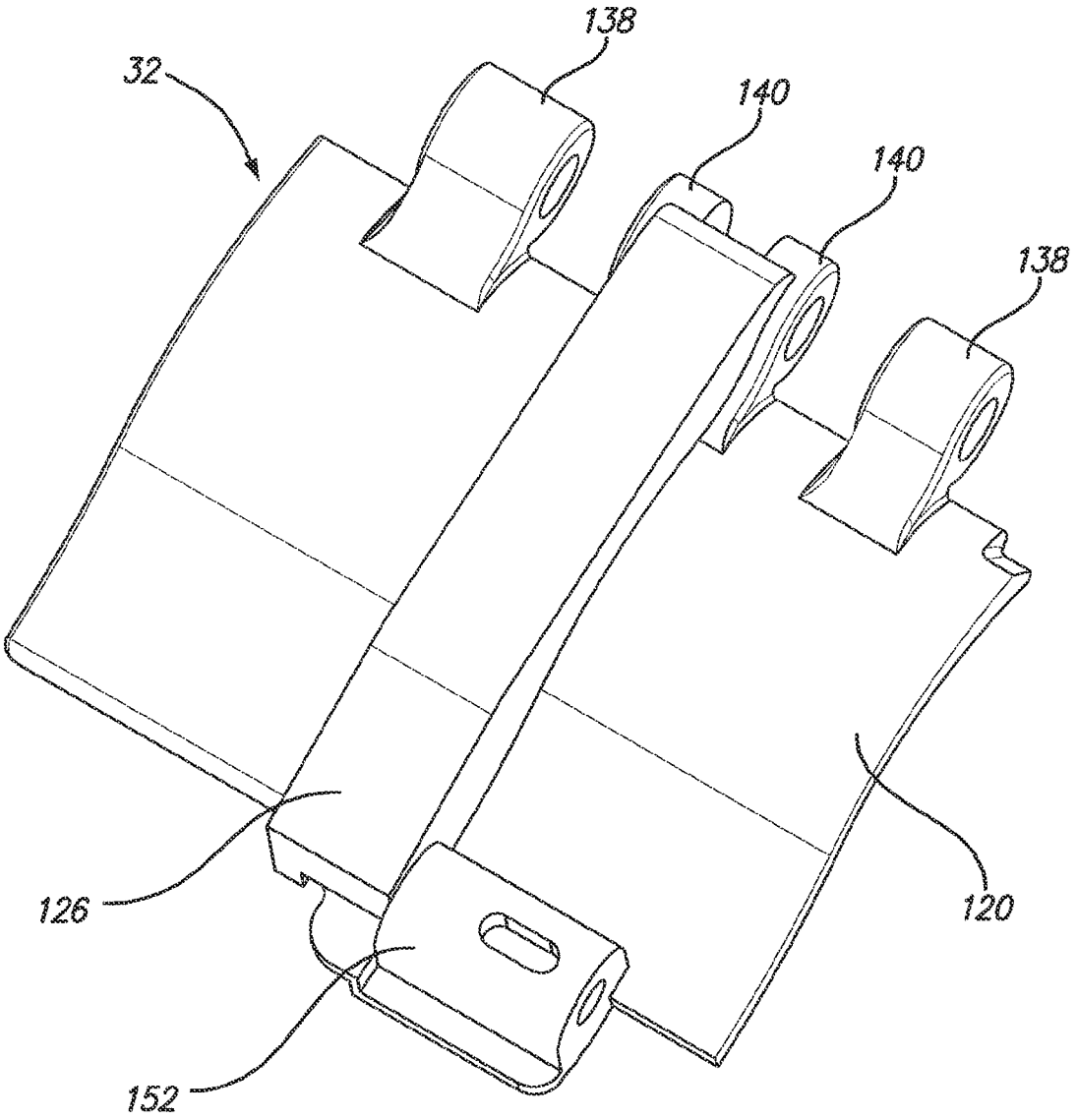
FIG. 7 is a top perspective view of the access door of the feeder door assembly of FIG. 6.
Figure 8:
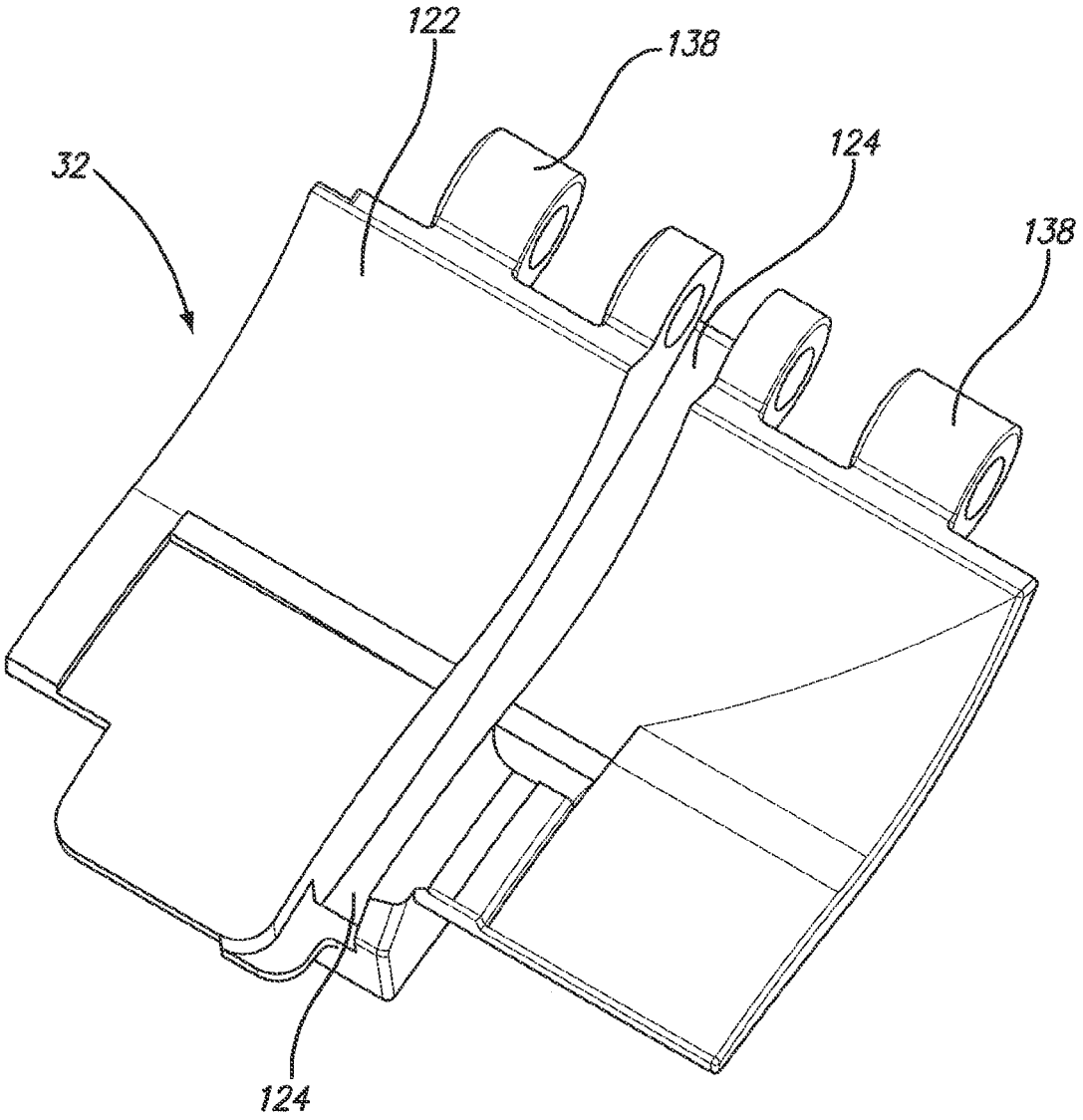
FIG. 8 is a bottom perspective view of the access door of FIG. 7, showing the door recess.
Figure 9:
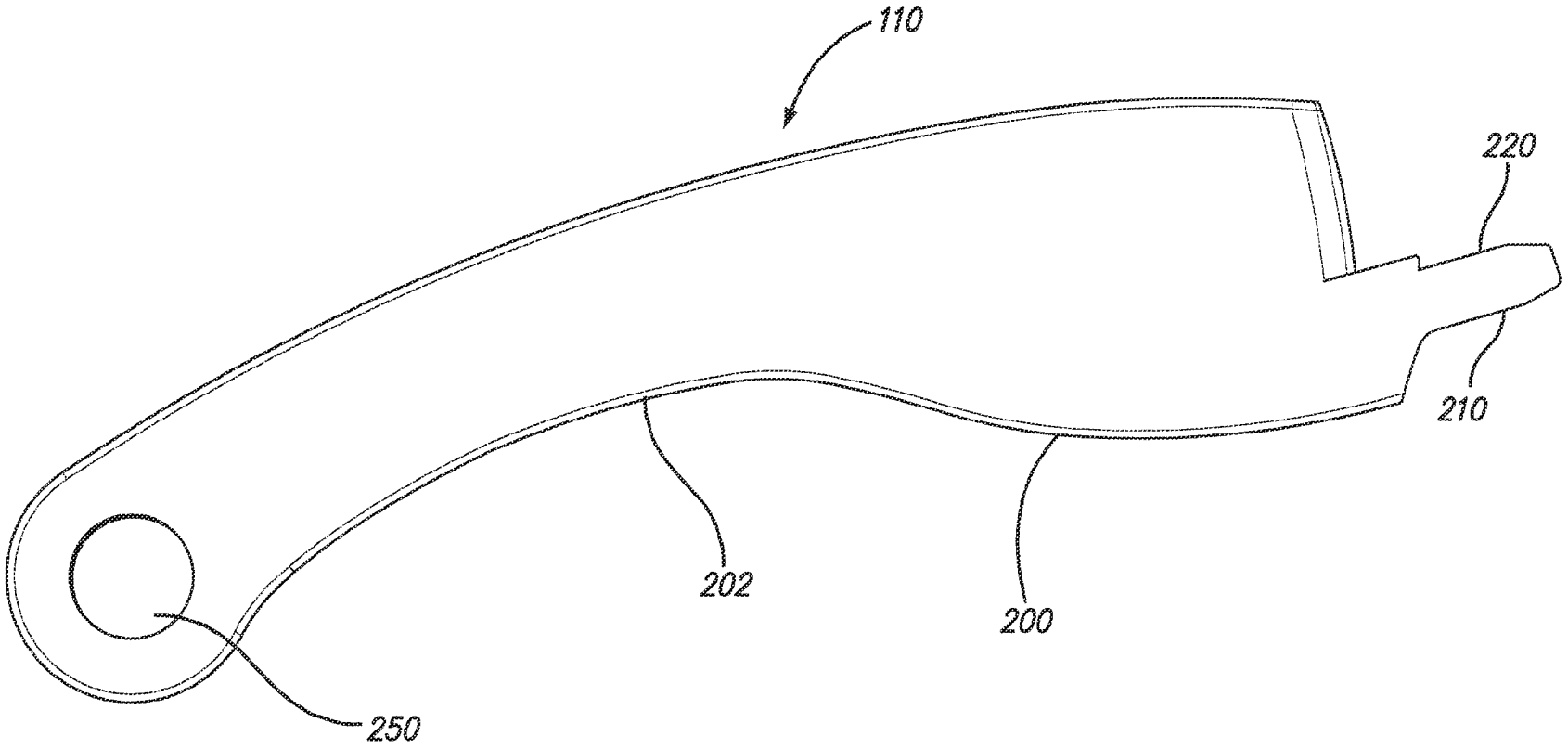
FIG. 9 is a side view of the feeder door tongue of the feeder door assembly of FIG. 6.
Figure 10:
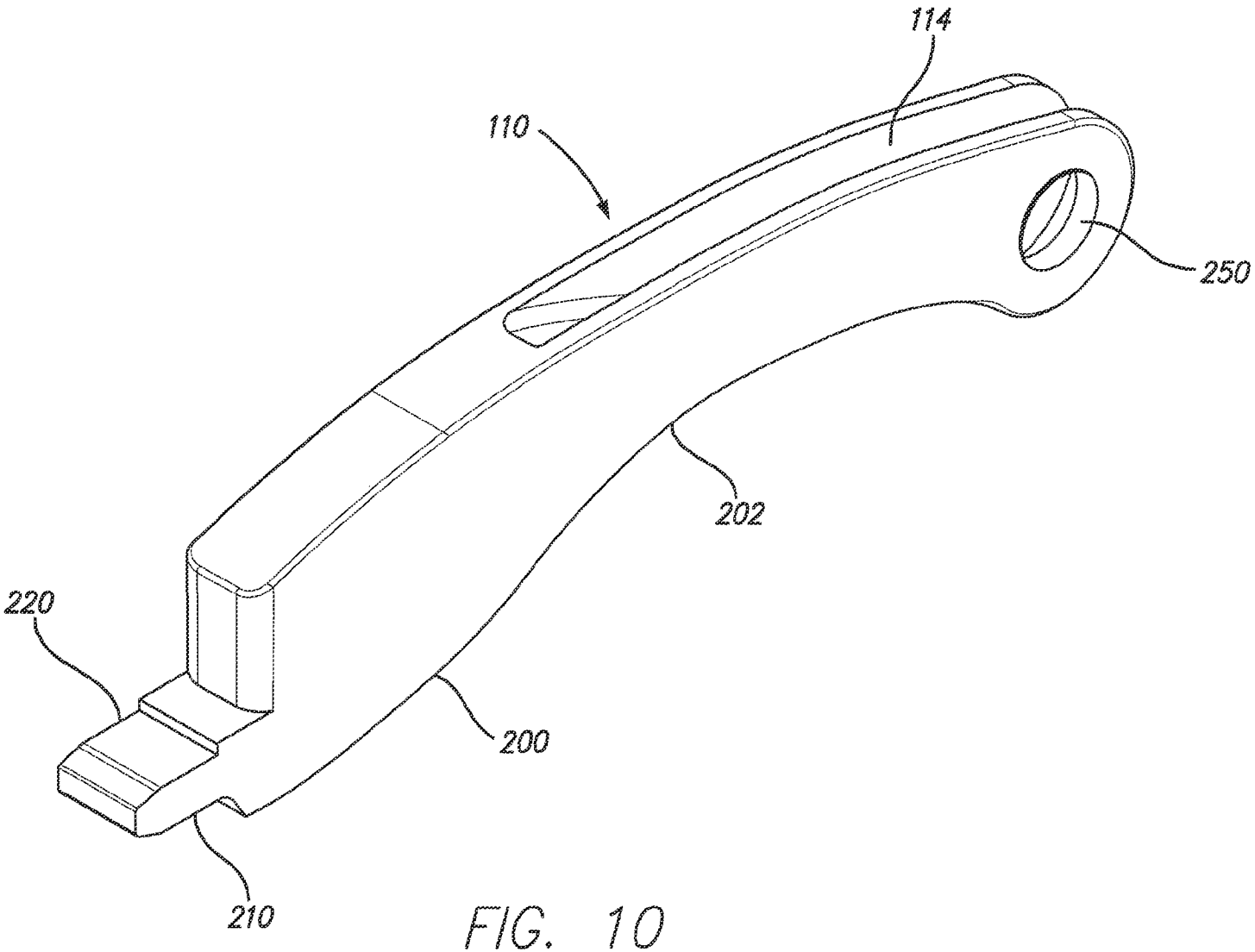
FIG. 10 is a top perspective view of the feeder door tongue of FIG. 9.
Figure 11:
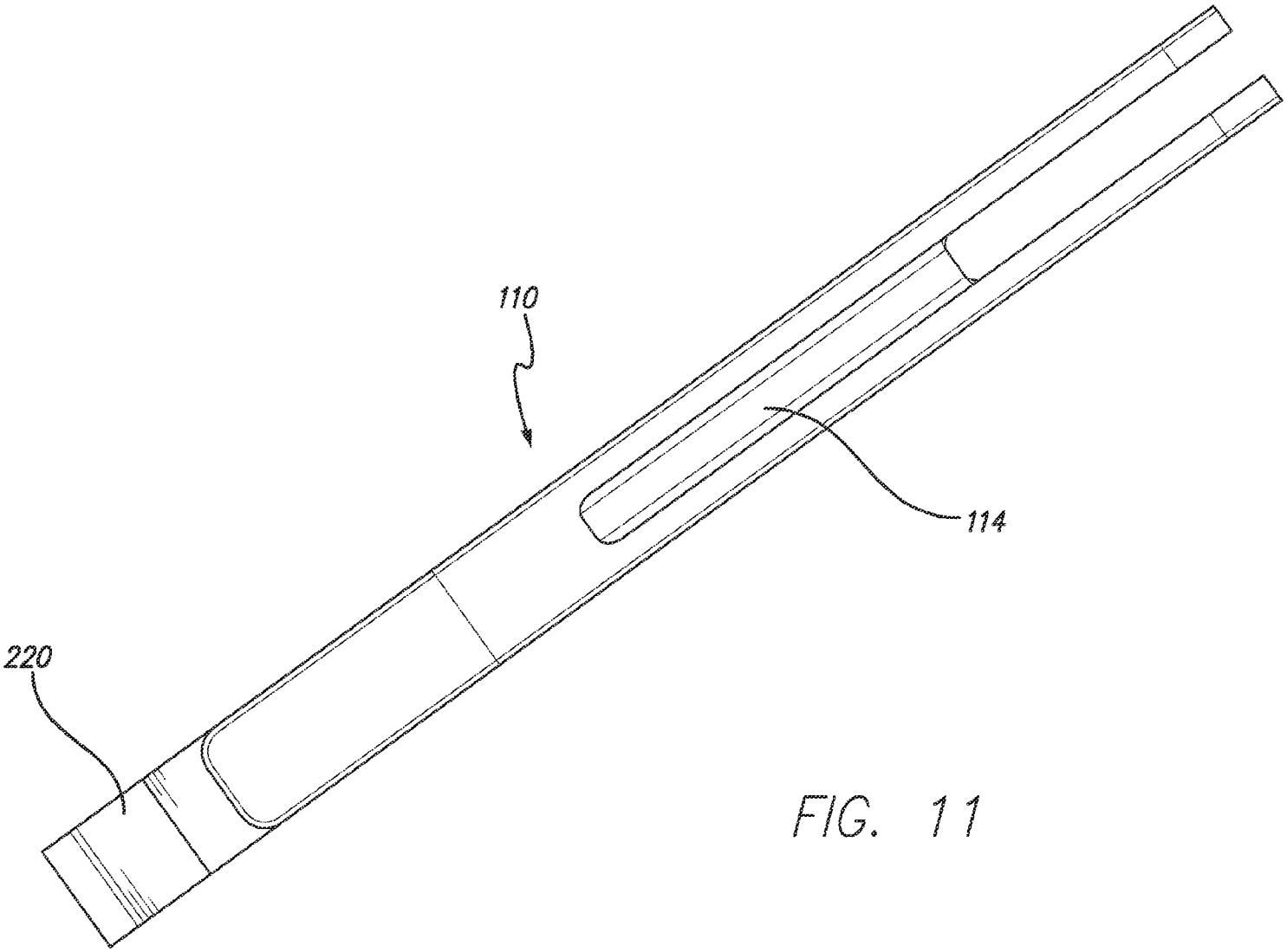
FIG. 11 is a top plan view of the feeder door tongue of FIG. 9.
Figure 16:
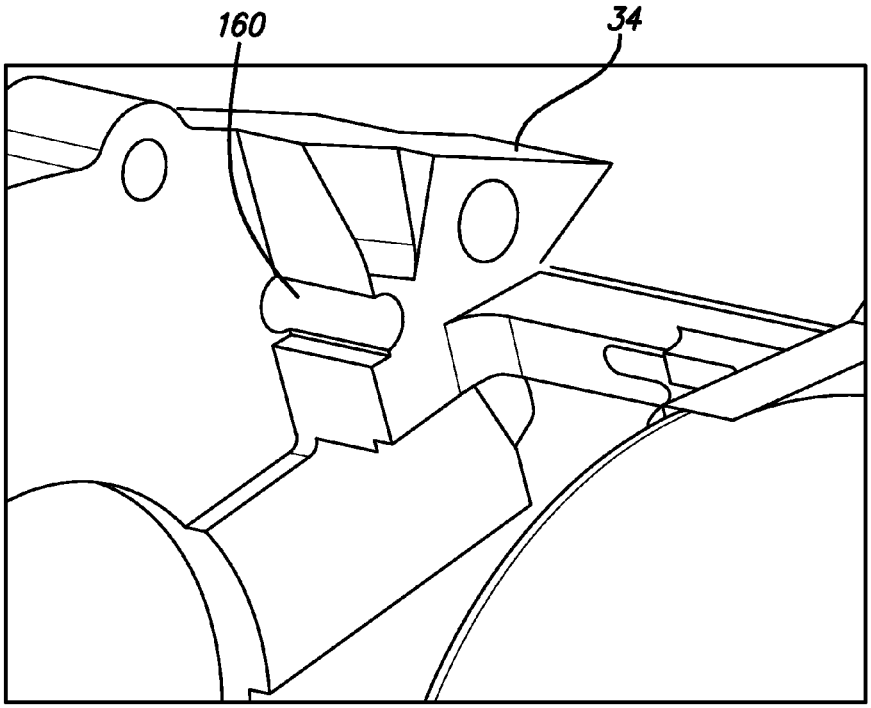
FIG. 16 is a perspective view of a portion of the interior the feeder housing, showing the housing latch aperture for receiving the latch pin of the feeder door assembly of FIG. 6.
Figure 18:
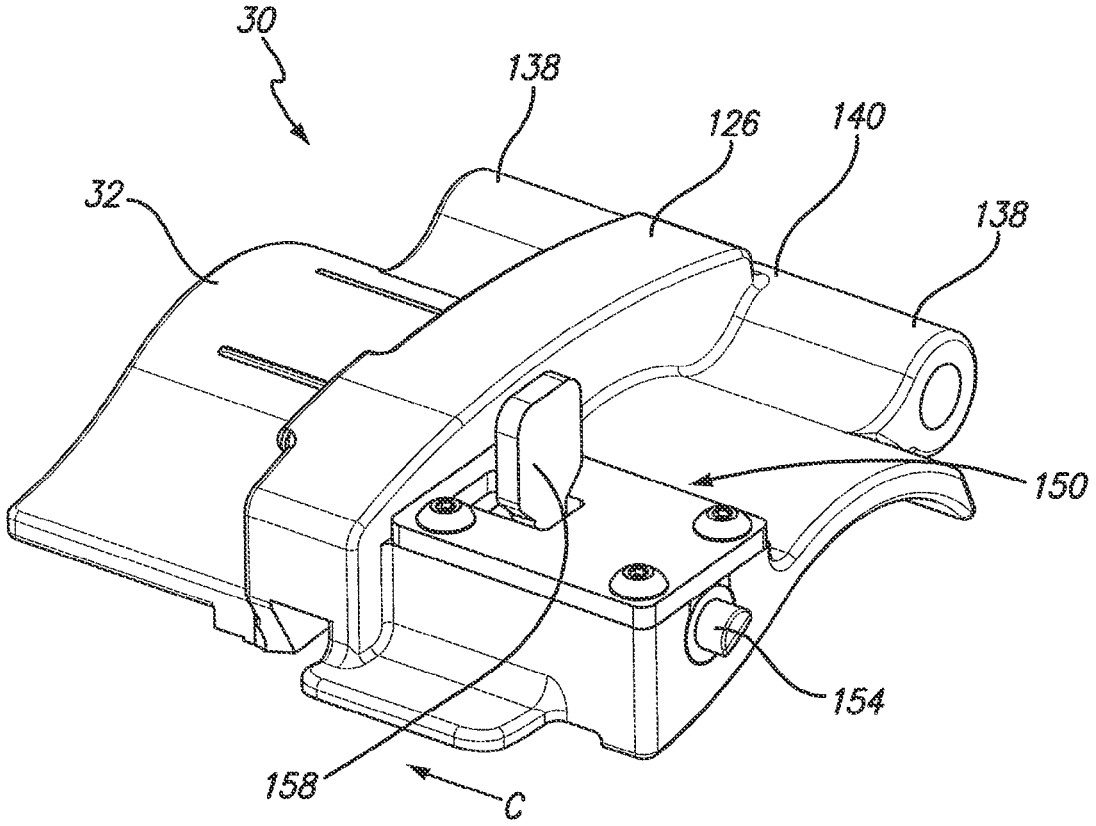
FIG. 18 is perspective view of another embodiment of an improved feeder door assembly according to the present invention.
Figure 19:
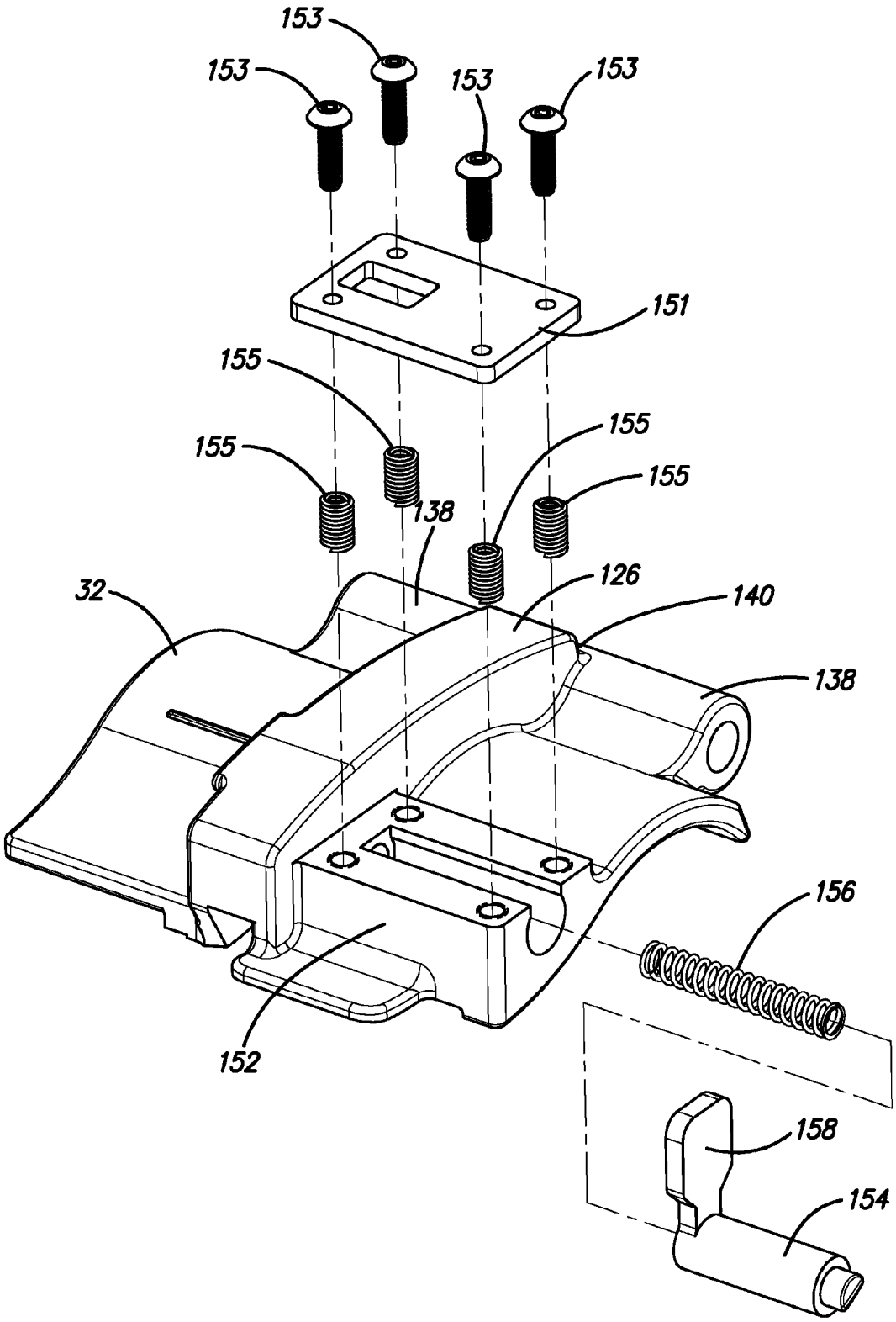
FIG. 19 is an exploded view of the feeder door assembly of FIG. 18.

Referring again to FIGS. 6 and 18-19, the feeder door assembly 30 also includes a spring-loaded latch 150 for locking the access door 32 when it is in the closed position. In the embodiment of FIG. 6, the latch 150 includes a housing 152 that is integrally formed with the access door 32, a latch pin 154 for engaging an aperture 160 in the housing 34 (see FIG. 16), a latch compression spring 156 for urging the latch pin 154 into the housing latch aperture 160 when the door 32 is in the closed position, and a latch release lever 158 for disengaging the latch pin 154 from the housing latch aperture 160 to allow the access door 32 to be opened. In the embodiment of FIGS. 18-19, a separate latch cover 151 is mounted to the latch housing 152 using screws 153 and threaded inserts 155. As shown in FIG. 19, with this embodiment, the latch pin 154 and release lever 158 can be integrated into a single unit, A user operates the feeder door assembly 30 as follows. To open the closed access door 32 and access the interior of the delinking feeder 16, a user manually displaces the latch lever 158 inwardly in the direction of arrow C (see FIG. 18) to disengage the latch pin 154 from the housing latch aperture 160. The user then can open the access door 32 in the direction of arrow B (see FIG. 4) from the closed position of FIG. 5 to the completely open position of FIG. 4. With an ammunition belt 101 and associated cartridges 80 inserted into the delinking feeder 16 in the manner known in the art, the user can place one or more fingers of one hand on a cartridge 80 to hold the cartridge in place, and with the other hand, can move the door 32 from the completely open position to a partially open position with the first contact surface 200 of the bottom surface of tongue 110 resting on and holding the cartridge 80 in place. The user then can remove his finger(s) from the cartridge 80 and move the door 32 from the partially opened position to the closed position of FIG. 5 such that latch pin 154 snaps into the housing latch aperture 160 and holds door 32 in the closed position.

The improved feeder door assembly of the present invention provides a number of advantages over prior art feeder door assemblies. Because it utilizes a single door, it reduces loading time in comparison to prior art door systems that utilize a pair of side-by-side access doors. In addition, the improved feeder door assembly eliminates jams that are prevalent with prior art door systems that utilize a single door. Moreover, because the improved feeder door assembly provides an enclosed environment for the delinking feeder, it provides better protection from dust and debris than prior art door systems.

Upon reading this disclosure, those skilled in the art will appreciate that various changes and modifications may be made to the preferred embodiments of the invention and that such changes and modifications may be made without departing from the spirit of the invention. Therefore, the invention in its broader aspects is not limited to the specific details, representative devices, and illustrative examples shown and described. Accordingly, departures may be made from such details without departing from the spirit or scope of the general inventive concept.

What is claimed is:

1. An improved door assembly for a delinking feeder of a minigun, the door assembly comprising:

an access door mountable to a delinking feeder housing and movable between a closed position and an open position;

wherein the access door includes an enclosed recess for receiving a tongue having a first contact surface for contacting and securing a linked cartridge positioned in the delinking feeder when the access door is in the open position;

wherein the tongue is rotationally coupled to the access door and is movable between a retracted position, wherein a portion of the tongue is disposed in the enclosed recess, and a deployed position, wherein the portion of the tongue is deployed from the access door;

wherein when the access door is in the open position, the tongue is in the deployed position and the tongue first contact surface can contact and secure a linked cartridge positioned in the delinking feeder; and wherein the tongue includes a recess configured for holding a portion of a torsion spring and wherein the torsion spring is configured to cause the tongue to rotate from the retracted position to the deployed position as the door moves from the closed position to the open position.

2. An improved door assembly for a delinking feeder of a minigun, the door assembly comprising:

an access door mountable to a delinking feeder housing and movable between a closed position and an open position;

wherein the access door includes an enclosed recess for receiving a tongue having a first contact surface for contacting and securing a linked cartridge positioned in the delinking feeder when the access door is in the open position;

wherein the tongue is rotationally coupled to the access door and is movable between a retracted position, wherein a portion of the tongue is disposed in the enclosed recess, and a deployed position, wherein the portion of the tongue is deployed from the access door;

wherein when the access door is in the open position, the tongue is in the deployed position and the tongue first contact surface can contact and secure a linked cartridge positioned in the delinking feeder;

wherein the tongue includes a second contact surface for contacting and guiding a cartridge positioned in the delinking feeder when the access door is in the closed position; and wherein when the access door is in the closed position, the tongue is in the retracted position and the tongue second contact surface can contact and guide a cartridge positioned in the delinking feeder.

3. The door assembly of claim 1 wherein the access door is configured for receiving a door hinge pin mounted to the delinking feeder housing and wherein the tongue includes an opening for receiving the door hinge pin.

4. The door assembly of claim 1 wherein the tongue includes an opening for receiving an access door hinge pin and the torsion spring includes a coiled portion configured for receiving the access door hinge pin.

5. The door assembly of claim 1 wherein the tongue includes a stop tab configured to limit the range of rotational travel of the tongue outwardly from the door recess.

6. The door assembly of claim 1 wherein the tongue includes a stop tab configured to limit the range of rotational travel of the door with respect to the delinking feeder housing.

* * * * *